United States Patent [19]

Brochu et al.

[11] Patent Number: 4,774,777

[45] Date of Patent: Oct. 4, 1988

[54] METHOD OF COLLECTING, PRESERVING AND REPOSITIONING SNOW ON A SKI SLOPE

[76] Inventors: Adrian Brochu; Andre Brochu, both of Box 92, Stratton, Me. 04982

[21] Appl. No.: 21,748

[22] Filed: Mar. 4, 1987

Related U.S. Application Data

[63] Continuation of Ser. No. 886,444, Jul. 17, 1986, abandoned, which is a continuation of Ser. No. 776,855, Sep. 18, 1985, abandoned.

[51] Int. Cl.[4] ..... E01H 4/00

[52] U.S. Cl. ..... 37/197

[58] Field of Search ..... 37/197, 219, 221; 272/56.5 SS; 239/23; 47/56; 256/62; 52/3.5, 169.11, DIG. 12; 404/76; 405/130

[56] References Cited

U.S. PATENT DOCUMENTS

| | | | |
|---|---|---|---|
| Re. 29,438 | 10/1977 | MacCracken . | |
| 489,227 | 1/1893 | Fuller . | |
| 983,857 | 2/1911 | Clarke . | |
| 1,052,498 | 2/1913 | McDonald . | |
| 1,875,188 | 8/1932 | Williams . | |
| 2,371,017 | 3/1945 | Arthur . | |
| 3,108,804 | 10/1963 | Wagner | 273/27 |
| 3,427,934 | 2/1969 | Zames | 272/56.5 SS |
| 3,446,571 | 5/1969 | Oberholtzer . | |
| 3,458,274 | 7/1969 | Cashman . | |
| 3,547,749 | 12/1970 | White et al. | 272/56.5 SS |
| 3,604,324 | 9/1971 | Middlestadt . | |
| 3,736,847 | 6/1973 | Hickey | 272/56.5 SS |
| 3,870,587 | 3/1975 | Merrell . | |
| 3,983,713 | 10/1976 | MacCracken | 272/3 X |
| 4,028,750 | 6/1977 | Gustafsson . | |
| 4,032,139 | 6/1977 | Gaudard | 272/56.5 SS |
| 4,050,169 | 9/1977 | Pasquier | 37/197 |
| 4,050,972 | 9/1977 | Cardinal, Jr. | 47/DIG. 11 |
| 4,136,222 | 1/1979 | Jonnes | 428/116 |
| 4,264,664 | 4/1981 | Kunz | 428/142 |
| 4,281,802 | 8/1981 | Burley | 242/55 |
| 4,313,993 | 2/1982 | McGlory | 428/178 |
| 4,386,128 | 5/1983 | Yoshikawa | 428/178 X |
| 4,402,908 | 9/1983 | Lee et al. | 252/382 X |
| 4,404,762 | 9/1983 | Munsterer | 37/219 |
| 4,413,029 | 11/1983 | Handwerker | 428/61 |
| 4,466,143 | 8/1984 | Lamb | 4/502 |
| 4,467,619 | 8/1984 | Kovach | 405/130 X |
| 4,484,420 | 11/1984 | Stokes | 52/2 |

FOREIGN PATENT DOCUMENTS

| | | | |
|---|---|---|---|
| 80172 | 2/1963 | France | 272/56.5 SS |
| 2483795 | 11/1981 | France . | |
| 2527465 | 2/1983 | France . | |
| 1073379 | 2/1984 | U.S.S.R. . | |
| 1061 | of 1914 | United Kingdom . | |

*Primary Examiner*—Eugene H. Eickholt

*Attorney, Agent, or Firm*—Samuels, Gauthier, Stevens, Kehoe

[57] ABSTRACT

A method of collecting, preserving and repositioning snow on a ski slope whereby the slope may be placed in condition for skiing in the fall prior to the time of sufficient fall of natural snow or the arrival of freezing conditions necessary for the production of man-made snow.

14 Claims, 1 Drawing Sheet

METHOD OF COLLECTING, PRESERVING AND REPOSITIONING SNOW ON A SKI SLOPE

This is a continuation of co-pending application Ser. No. 886,444 now abandoned, filed on July 17, 1986 and which, in turn, is a continuation of Ser. No. 776,855 filed Sept. 18, 1985, now abandoned.

BACKGROUND OF THE INVENTION

Skiing on ski slopes or trails terminates in the late winter and early spring with the melting of the snow. The slopes and trails become bare over the summer months. Skiing normally resumes in the fall or early winter when sufficient snow has fallen to provide adequate snow cover on the slopes and trails.

In a few instances, early fall skiing has been achieved by the spreading of man-made snow but the success of this process is dependent on the arrival of nights with below freezing temperatures.

SUMMARY OF THE PRESENT INVENTION

The present invention is to a method whereby any selected ski slope or trail may be placed in skiing condition earlier in the fall than would normally be the case. Hereinafter when the term ski slope is used it will also include a ski trail. The method will be most commonly used on ski slopes.

The method comprises the steps of closing the selected slope in the late winter or early spring while there is still adequate snow cover thereon. The snow is then concentrated by hand or machine into a series of piles over the entire length of the slope. These piles will be high in the center and tapering downwardly to the surrounding ground. The piles preferably will be circular. The spacing of the piles will be determined by the depth and location of the snow available.

The piles of snow are then covered with sheets of insulating material of such character that a major volume of the piled snow will be preserved over the summer and early fall months. When the average ambient temperature has dropped in the fall to a degree at which the snow will not melt away, the piles will be uncovered and the snow redistributed, by hand and/or machine over the selected areas of the slope. The depth of the redistributed snow now covering the selected slope area will be adequate for immediate skiing and will last until the arrival of natural snow. Should the arrival of natural snow be delayed, the snow base can be augmented by the application of man-made snow at the necessary locations after nighttime freezing conditions have arrived in the fall.

DETAILED DESCRIPTION OF THE INVENTION

Figure 1:
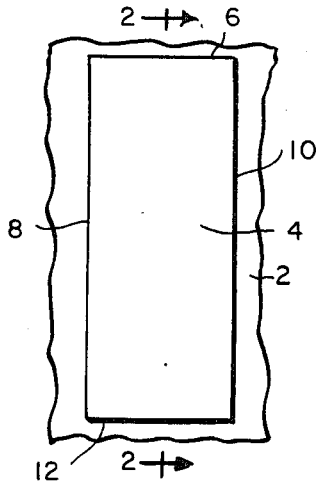
FIG. 1 is a plan view of a snow covered ski slope.

FIG. 1 is intended to represent any ski slope 2 which is covered with snow 4. For help in explanation of the invention, the snow covered area of the slope is shown as having top, side and bottom boundaries indicated at 6, 8, 10 and 12.

Figure 2:
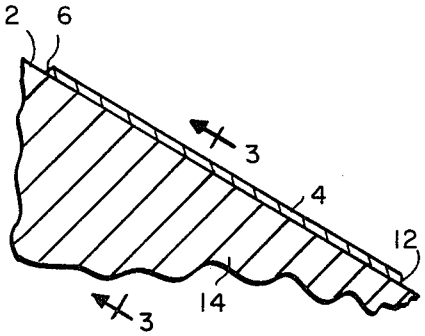
FIG. 2 is a vertical section on the line 2—2 of FIG. 1.
Figure 3:
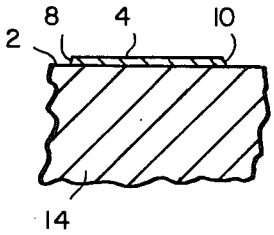
FIG. 3 is a section on the line 3—3 of FIG. 2.

FIG. 2 is a vertical section taken on the line 2—2 of FIG. 1 showing the ground 14 with the snow 4 covering the sloping surface 2. The upper limit of the snow with which we are concerned is at 6 and the bottom limit at 8. FIG. 3 is a section taken on the line 3—3 of FIG. 2.

It is to be understood that the representation of FIGS. 1, 2 and 3 is intended to include any ski slope having thereon snow (natural, natural and man-made or man-made) toward the end of the skiing season when the operator elects to close the slope.

It will be appreciated that the depth and disposition of the snow at the time the slope is closed may vary greatly depending upon the extent of the snow fall over the past winter and the configuration of the ground surface.

Figure 4:
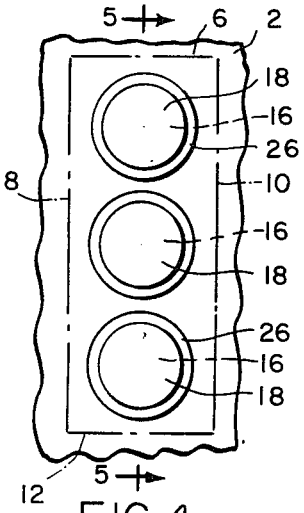
FIG. 4 is a plan view of the ski slope of FIG. 1 with the snow thereon pushed into a plurality of piles.
Figure 5:
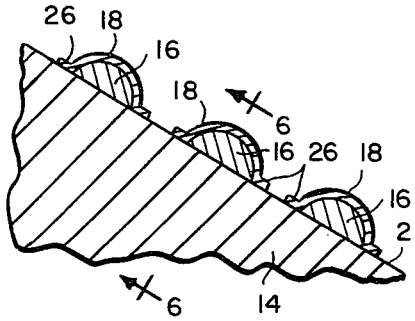
FIG. 5 is a vertical section on the line 5—5 of FIG. 4.
Figure 6:
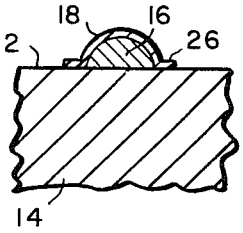
FIG. 6 is a section on the line 6—6 of FIG. 5.

The snow on the slope is pushed, preferably by machines, into a plurality of piles of snow indicated at 16 in FIGS. 4, 5 and 6. The location of the piles of snow on the slope will be dictated by the configuration of the slope, the depth of the snow and the judgment of the operator. The piles are made as high as possible, preferably generally circular in plan and are then covered with sheets of insulating material 18 of such properties as to be capable of preserving a major portion of the snow over the summer and early fall.

In places where the snow is deep, it may be pushed into suitably sized piles without using all of the snow adjacently available. Where the snow cover is thin, it may be necessary to use all of the snow at that location to produce a large enough pile to survive the summer. In all cases the object is to preserve enough snow by the piling procedure plus the insulating covering to have enough snow available in the fall which when spread on the slope will create adequate skiing conditions. Preferably the area of the collected snow pile should be small in relation to the area from which the snow was collected. In other words, a high pile on a small area is preferably to a lower pile in a larger area because the percentage loss from melting is approximately inversely proportional to the height of the pile. Snow can readily be piled by machine to a height of 20 feet or more at the center and sloping to the sides in a circular pattern. A pile of snow of this character covered with suitable insulating material will lose no more than 20 to 25% of its volume over the summer. Thus for example if there was an average of two feet of snow on the slope when the piling commenced and all of it was pushed into the piles, enough snow would remain by fall to cover the slope to an average depth more or less of one and one-half feet, adequate for immediate skiing.

Figure 8:
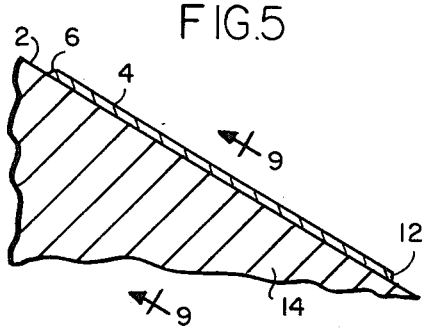
FIG. 8 is a vertical section on the line 8—8 of FIG. 7.
Figure 9:
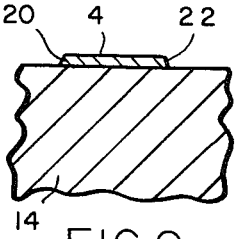
FIG. 9 is a section on the line 9—9 of FIG. 8.
Figure 10:
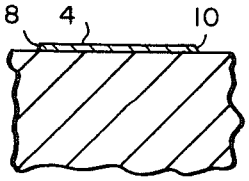
FIG. 10 is a view similar to FIG. 9 but showing the snow covering a greater area.
Figure 7:
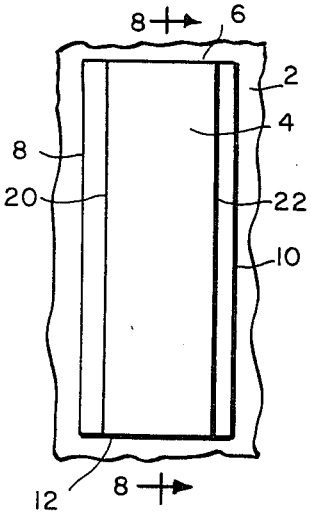
FIG. 7 is a plan view of the ski slope of FIGS. 1 and 4 with the piled snow of FIGS. 4, 5 and 6 redistributed on the slope.

FIGS. 7, 8 and 9 are illustrative of the condition of the slope following distribution of the snow in the fall from the piles 16 shown in FIGS. 4, 5 and 6. In FIG. 7, the lines 20 and 22 suggest the somewhat reduced width of the slope if the original depth is provided whereas FIG. 9 suggests a width of slope corresponding to boundaries 8 and 10 of FIGS. 1 and 3 but with a reduced depth determined by the extent of the melting.

Figure 11:
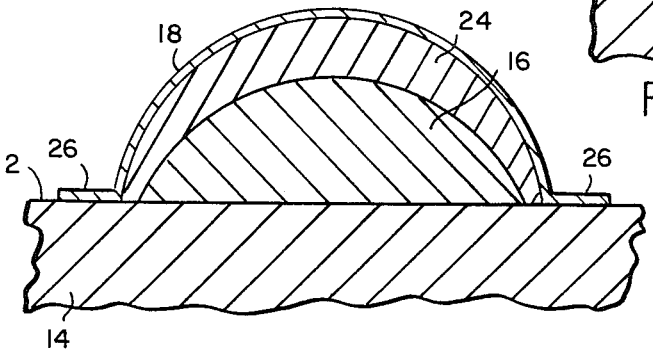
FIG. 11 is an enlarged view illustrating a snow pile to which man-made snow has been added.

It has been found desirable and practical in some situations to increase the volume of the preserved pile of snow by removing the cover 18, adding man-made snow and recovering the pile as shown in FIG. 11. This procedure would be used when the residual layer of snow available in the spring was inadequate for producing the depth initially wanted in the fall. The addition of man-made snow can be made whenever the temperature falls below freezing which condition usually begins early in the fall. Repeated additions of man-made snow will create a pile sufficient when spread to provide skiing conditions on the selected area. FIG. 11 suggests the condition existing after man-made snow 24 has been added to the initial pile of snow 16 and the covering 28 replaced.

The process of accumulating the residual snow in piles in the spring and distributing it in the fall will preferably proceed from the top to the bottom of the slope as the snow movement is aided by gravity but this process may be varied under the judgment of the machine operator.

Insulating covering adequate to preserve snow over the summer is available in the open market. One such material comprises two layers of aluminum foil spaced about $\frac{1}{4}$ inch between which are two layers of polyethylene bubbles. These circular flattened bubbles, about $\frac{3}{8}$ inch in diameter are arranged so that each bubble is surrounded by six other bubbles, all bonded to themselves and to the covering layers of aluminum foil. This construction forms a strong sheet having the capability of substantially limiting passage of the sun's radiant heat and the heat of the ambient air to the snow thereunder. The sheet may be further strengthened by a coating of clear polyethylene to both exterior sides. This sheet is light, flexible and durable and may be readily rolled on and off each pile of snow.

The sheets must be firmly anchored to the ground to prevent the sheets from being dislodged by the wind and also to prevent the entrance of warm air under the sheets which would cause excessive melting of the covered snow. The sheets may be anchored for example by placing weights on the edge areas 26 or in any other manner available. The securing means must be readily removable so that the sheets can be rolled off the piles and saved for use the following year.

In the drawings, it will be understood that the thickness of the sheets in relation to the size of the piles of snow has necessarily been exaggerated for purpose of illustration.

It is intended to cover all changes and modifications of the example of the invention herein chosen for purposes of the disclosure which do not constitute departures from the spirit and the scope of the invention.

We claim:

1. In snow cover management at a ski area, the method of seasonally shifting snow coverage on a designated ski slope in order to achieve skiing on said designated slope at a time of the year when said slope would otherwise be closed for skiing because of inadequate snow cover which method comprises:

(A) at a time of the year when said designated slope could otherwise remain open for skiing, closing said designated slope; collecting the snow remaining on said designated slope into a series of piles distributed over the entire length of the slope; and, covering said piles with sheets of insulating material by placing said sheets over said piles such that they are substantially supported by the snow in said piles; and, (B) at a time of the year when said designated slope would otherwise be closed for skiing, uncovering said piles and distributing the snow remaining in said piles across said designated slope so as to achieve a depth satisfactory for skiing thereon.

2. The method of claim 1 wherein the periphery of each of said sheets of insulating material is anchored to the ground surrounding each said pile.

3. The method of claim 1 wherein said piles of snow have a height of approximately 20 feet or more at the center.

4. The method of claim 1 wherein said designated slope is closed for skiing while there remains an average snow depth of at least about two feet thereon.

5. The method of claim 1 additionally comprising the steps of uncovering said piles of snow, adding additional snow thereto to increase the size of said piles, and recovering the piles.

6. The method of claim 1 wherein said sheets of insulating material are rolled onto each pile of snow to cover it and rolled off to uncover it.

7. In snow cover management at a ski area, the method of seasonally shifting snow coverage on a designated ski slope in order to achieve skiing on said designated slope at a time of the year when said slope would otherwise be closed for skiing because of inadequate snow cover which method comprises:

(A) at a time of the year when said designated slope could otherwise remain open for skiing, closing said designated slope; collecting the snow remaining on said designated slope into a series of snow piles distributed over the entire length of the slope; and, covering said snow piles with sheets of insulating material, wherein said sheets comprise two layers of aluminum foil spaced about one-quarter inch apart between which are two layers of polyethylene bubbles, by placing said sheets over said snow piles such that they are substantially supported by the snow in said snow piles; and, (B) at a time of the year when said designated slope would otherwise be closed for skiing, uncovering said snow piles and distributing the snow remaining in said snow piles across said designated slope so as to achieve a depth satisfactory for skiing thereon.

8. The method of claim 7 further wherein the polyethylene bubbles in said sheets of insulating material comprise circular, flattened bubbles arranged so that each bubble is surrounded by six other bubbles, all bonded to themselves and to the covering layers of aluminum foil.

9. The method of claim 7 additionally comprising the step of coating said sheets of insulating material with clear polyethylene applied to both exterior sides.

10. The method of claim 7 wherein the periphery of each of said sheets of insulating material is anchored to the ground surrounding each said snow pile.

11. The method of claim 7 wherein said piles of snow have a height of approximately 20 feet or more at the center.

12. The method of claim 7 wherein said designated slope is closed for skiing while there remains an average snow depth of at least about two feet thereon.

13. The method of claim 7 additionally comprising the steps of uncovering said piles of snow, adding additional snow thereto to increase the size of said piles, and recovering the piles.

14. The method of claim 7 wherein said sheets of insulating material are rolled onto each pile of snow to cover it and rolled off to uncover it.

* * * * *